US008701224B2

(12) United States Patent
Li et al.

(10) Patent No.: US 8,701,224 B2
(45) Date of Patent: Apr. 22, 2014

(54) PRESS TOUCH POP-UP STOPPER

(75) Inventors: Chunhung Li, Taichung (TW); Weimien Hsu, Taichung (TW); Juntao Xia, Guangdong Pr. (CN)

(73) Assignee: Globe Union Industrial Corp., Taichung (TW)

( * ) Notice: Subject to any disclaimer, the term of this patent is extended or adjusted under 35 U.S.C. 154(b) by 427 days.

(21) Appl. No.: 13/111,075

(22) Filed: May 19, 2011

(65) Prior Publication Data

US 2012/0291191 A1 Nov. 22, 2012

(51) Int. Cl.

| | |
|---|---|
| ***E03C 1/232*** | (2006.01) |
| ***E03C 1/23*** | (2006.01) |
| ***E03C 1/26*** | (2006.01) |
| ***A47K 1/14*** | (2006.01) |

(52) U.S. Cl.
USPC ..... 4/684; 4/689; 4/287; 4/295

(58) Field of Classification Search
USPC ..... 4/295, 286–287, 689, 688, 684
See application file for complete search history.

(56) References Cited

U.S. PATENT DOCUMENTS

| | | | | |
|---|---|---|---|---|
| 6,195,819 | B1 * | 3/2001 | Wang | 4/689 |
| 2008/0178382 | A1 * | 7/2008 | Pinette et al. | 4/689 |
| 2009/0271919 | A1 * | 11/2009 | Scorvo | 4/287 |
| 2010/0024108 | A1 * | 2/2010 | Yang et al. | 4/295 |

* cited by examiner

*Primary Examiner* — Gregory Huson
*Assistant Examiner* — Christine Skubinna

(57) ABSTRACT

A press touch pop-up stopper is used in a basin and contains a pipe set fixed in an opening of a bottom end of the basin and including a hole disposed therein and having an outlet fixed on a top end of the hole; a stopper assembly received in the pipe set and including a plug, after the plug is pressed, it bounces automatically to turn on the outlet so as to flow water, after the plug is pressed again, it closing the outlet to stop flowing the water; a vertical connecting structure defined between the pipe set and the stopper assembly so that when the stopper assembly is pulled upward, it disengages from the pipe set, and when the stopper assembly is pressed downward to be received in the pipe set, it is connected with the pipe set.

7 Claims, 8 Drawing Sheets

PRESS TOUCH POP-UP STOPPER

BACKGROUND OF THE INVENTION

1. Field of the Invention

The present invention relates to a press touch pop-up stopper that is cable of being cleaned easily and quickly.

2. Description of the Prior Art

A conventional basin includes an opening disposed on a bottom end thereof to flow water, and a plastic plug is used to close the opening manually, wherein when flowing the water, the plug has to be pulled outward.

A conventional touch pop-up stopper fixed in the opening to be operated manually contains a pipe set with an outlet disposed on the opening of the basin and a stopping member secured therein, wherein a bottom end of the stopping member is installed in a Tee tube to connect with a lever of one side of the Tee tube, and the touch pop-up stopper includes a longitudinal post moved vertically and axially coupled with an outer end of the lever, a top end of the longitudinal post extends over a faucet through the basin, hence when a user moves the longitudinal post to actuate the lever, the lever actuates the stopping member to turn on or close the outlet of the pipe set to flow or stop flowing the water.

In addition, a conventional press touch pop-up stopper disclosed in U.S. Pat. No. 6,195,819 B1 contains a pipe set fixed in an opening of a bottom end of a basin and a stopper assembly to flow water or stopp flowing the water, wherein the stopper assembly includes a housing, a pushing member, a rotating member, a spring, a bottom casing, a lid, and a sealing ring 16; wherein the pushing member is capable of moving vertically in the housing and acts against the rotating member by using the spring so that the rotating member is pressed by the lid to actuate the pushing member and the sealing ring to bounce upward automatically, such that the outlet is turned on to flow the water; thereafter, the rotating member is pressed again to be positioned on the housing so as to be further located at a lower position so that the pushing member and the sealing ring move downward to close the outlet, thus stopping flowing the water.

However, the stopped assembly and the pipe set of the conventional press touch pop-up stopper are an integrally formed components, so hairs or soap remains will be jammed between the stopper assembly and the pipe set or in the stopper assembly without being cleaned. Furthermore, it is difficult to remove the stopper assembly from the pipe set to have a cleaning process, accordingly the press touch pop-up stopper can not flow the water or stop flowing the water well.

The present invention has arisen to mitigate and/or obviate the afore-described disadvantages.

SUMMARY OF THE INVENTION

The primary object of the present invention is to provide a press touch pop-up stopper which is capable of overcoming the shortcomings of the conventional press touch pop-up stopper.

Another object of the present invention is to provide a press touch pop-up stopper that is cable of being cleaned easily and quickly so as to flow water and to stop flowing the water well.

To obtain the above objectives, a press touch pop-up stopper provided by the present invention contains:

a pipe set fixed in an opening of a bottom end of the basin and including a hole disposed therein and having an outlet fixed on a top end of the hole;

a stopper assembly received in the pipe set and including a plug, after the plug is pressed, it bounces automatically to turn on the outlet so as to flow a water, after the plug is pressed again, it closing the outlet to stop flowing the water;

a vertical connecting structure defined between the pipe set and the stopper assembly so that when the stopper assembly is pulled upward, it disengages from the pipe set, and when the stopper assembly is pressed downward to be received in the pipe set, it is connected with the pipe set.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
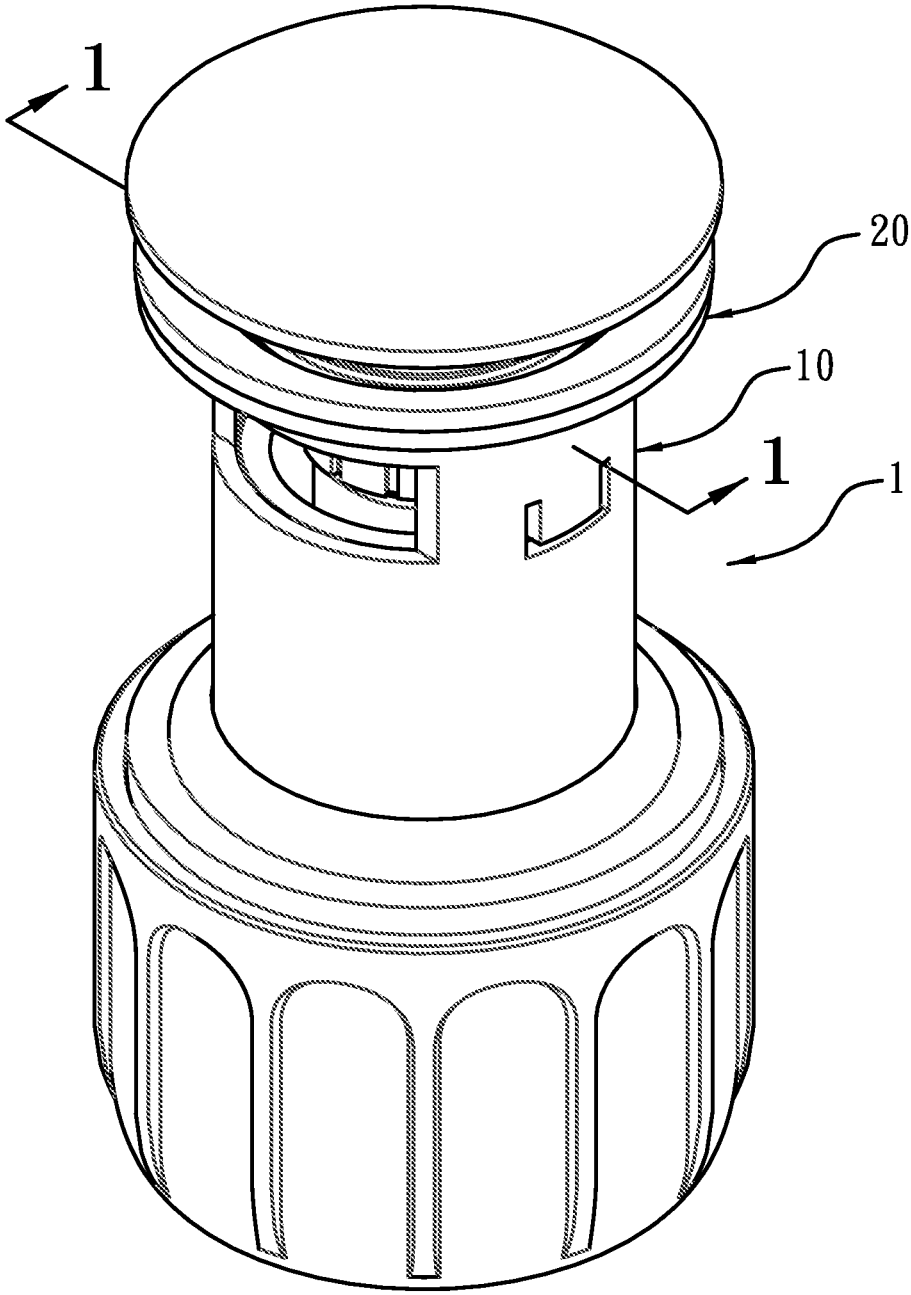
FIG. 1 is a perspective view showing the assembly of a press touch pop-up stopper according to the present invention.
Figure 2:
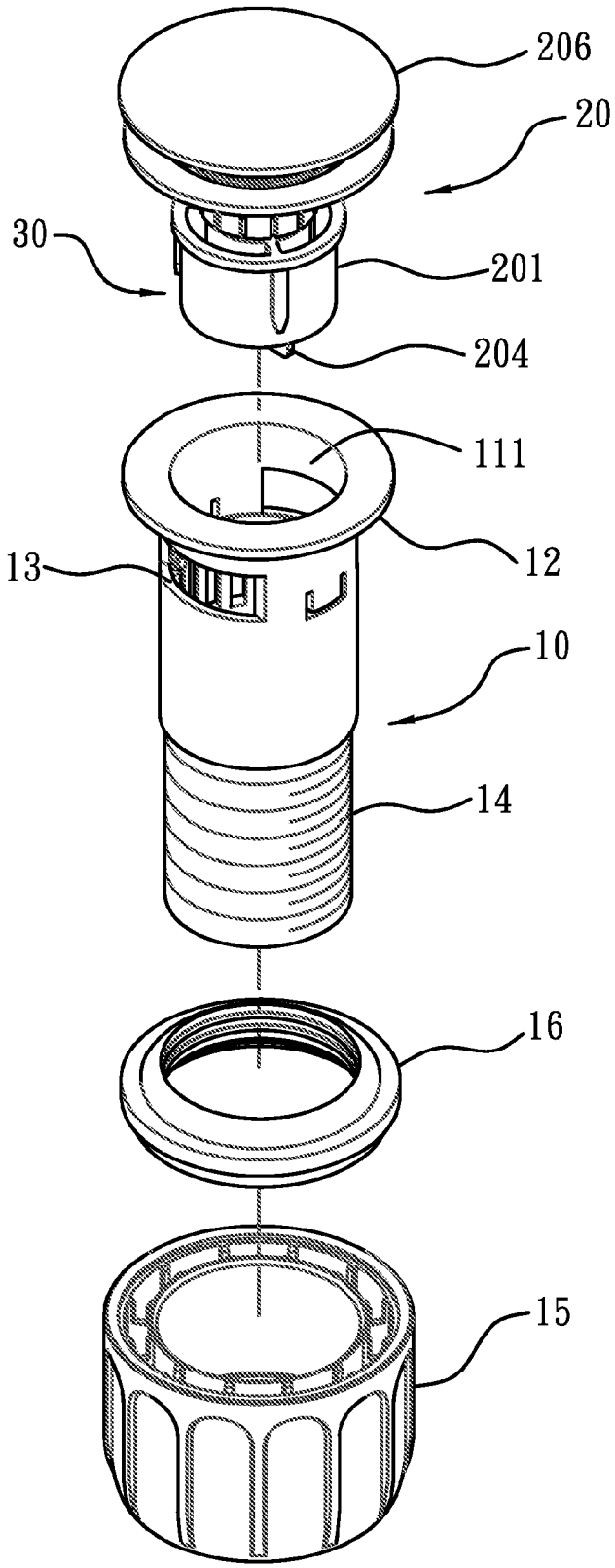
FIG. 2 is a perspective view showing the exploded components of the press touch pop-up stopper according to the present invention.
Figure 3:
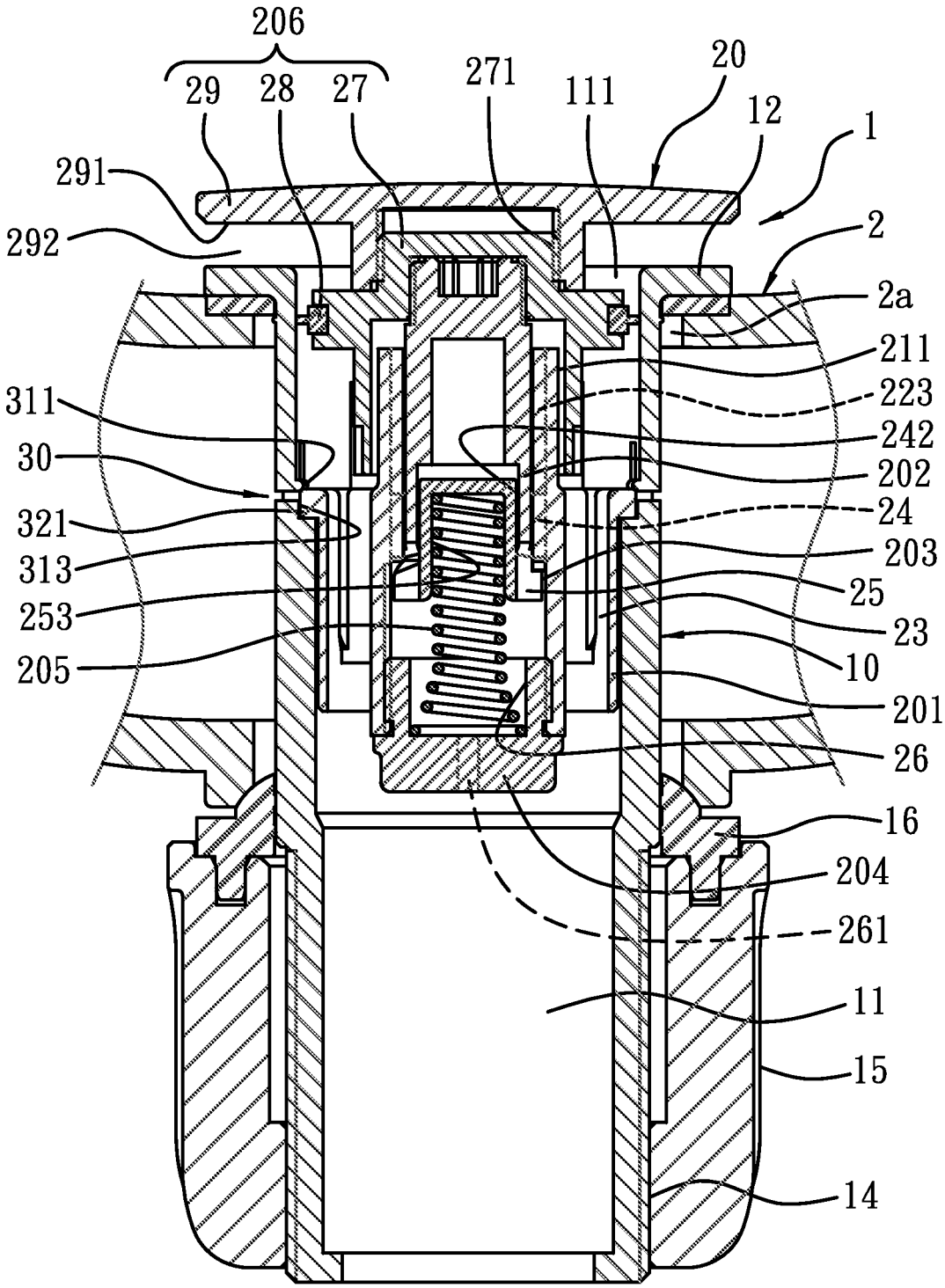
FIG. 3 is a cross sectional view taken along the line 1-1 of FIG. 1.

Referring to FIGS. 1-3, a press touch pop-up stopper 1 according to a first embodiment of the present invention is fixed in an opening 2*a* of a bottom end of a basin 2 and comprises a pipe set 10, a stopper assembly 20, and a vertical connecting structure 30.

Figure 4:
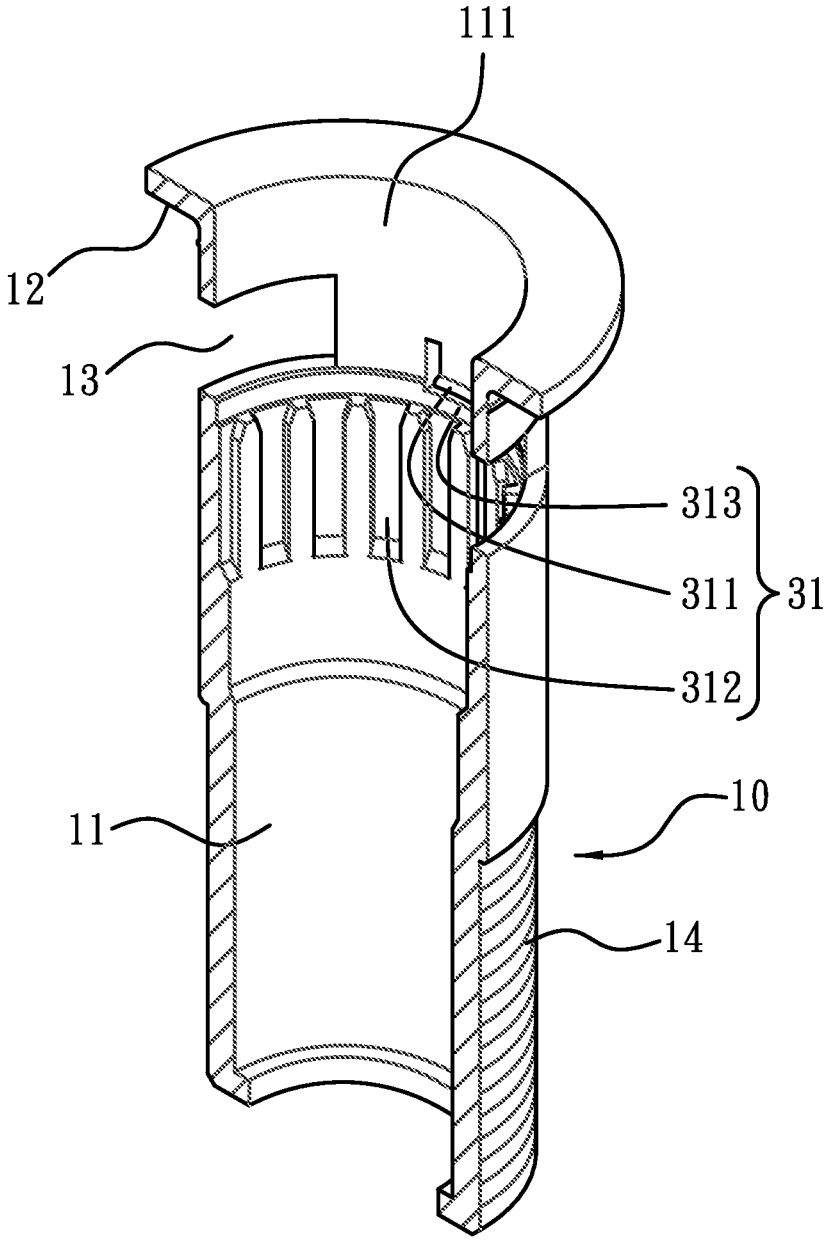
FIG. 4 is a perspective view showing a cross section of the press touch pop-up stopper according to the present invention.

The pipe set 10, as shown in FIG. 4, includes a hole 11 disposed therein and having an outlet 111 fixed on a top end of the hole 11, a positioning fringe 12 formed on a top end thereof to contact with an inner surface of the opening 2*a* of the basin 2, two opposite air vents 13 arranged thereon, outer threads 14 secured on a bottom end thereof to screw with a nut 15 so that a sealing ring 16 of the pipe set 10 engages with an outer surface of the bottom end of the basin 2, such that the pipe set 10 is locked in the opening 2*a* of the basin 2.

Figure 5:
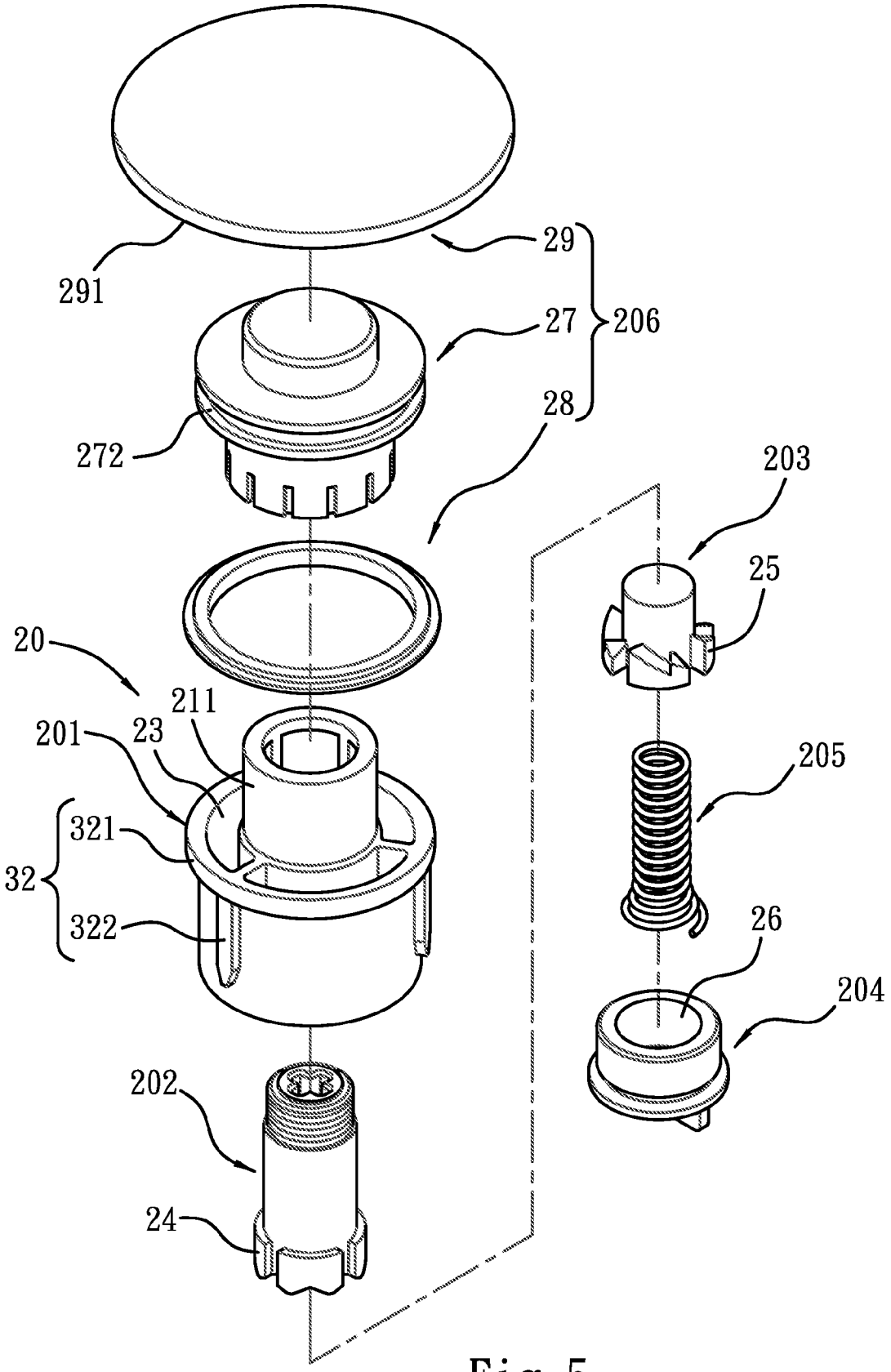
FIG. 5 is a perspective view showing the exploded components of the press touch pop-up stopper according to the present invention.
Figure 6:
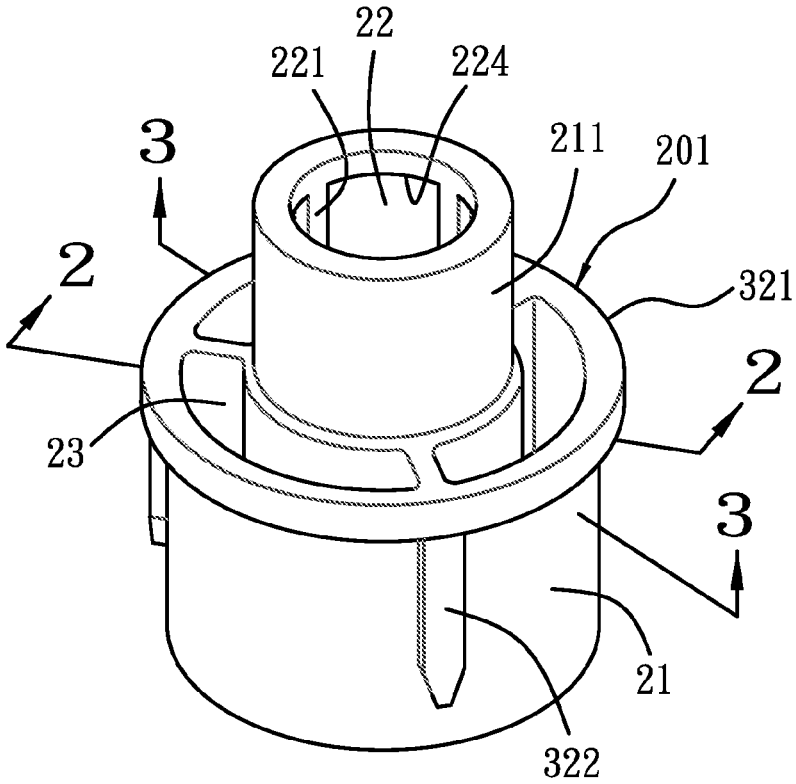
FIG. 6 is a perspective view showing the assembly of a housing of the press touch pop-up stopper according to the present invention.
Figure 7:
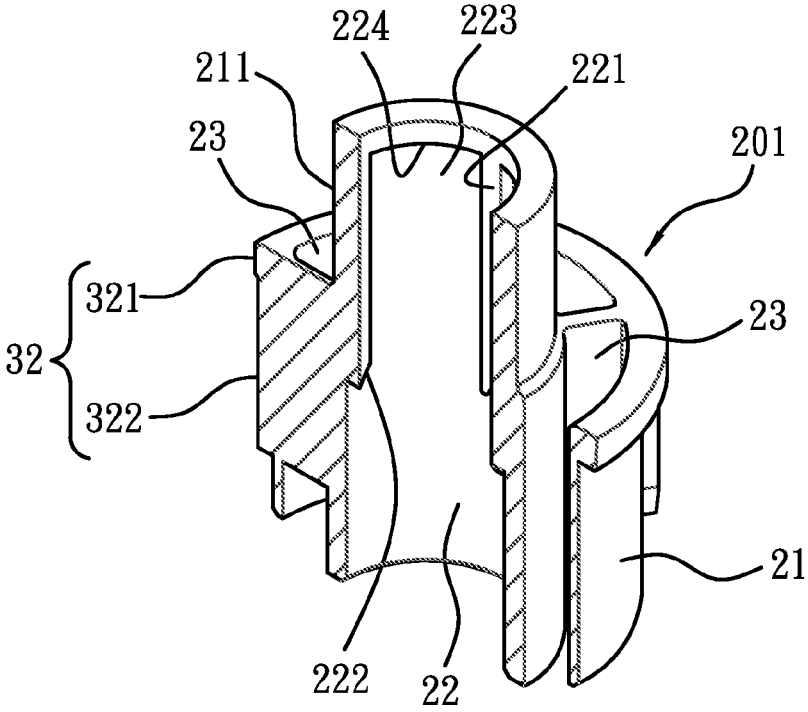
FIG. 7 is a cross-sectional perspective view taken along the line 2-2 of FIG. 6.
Figure 8:
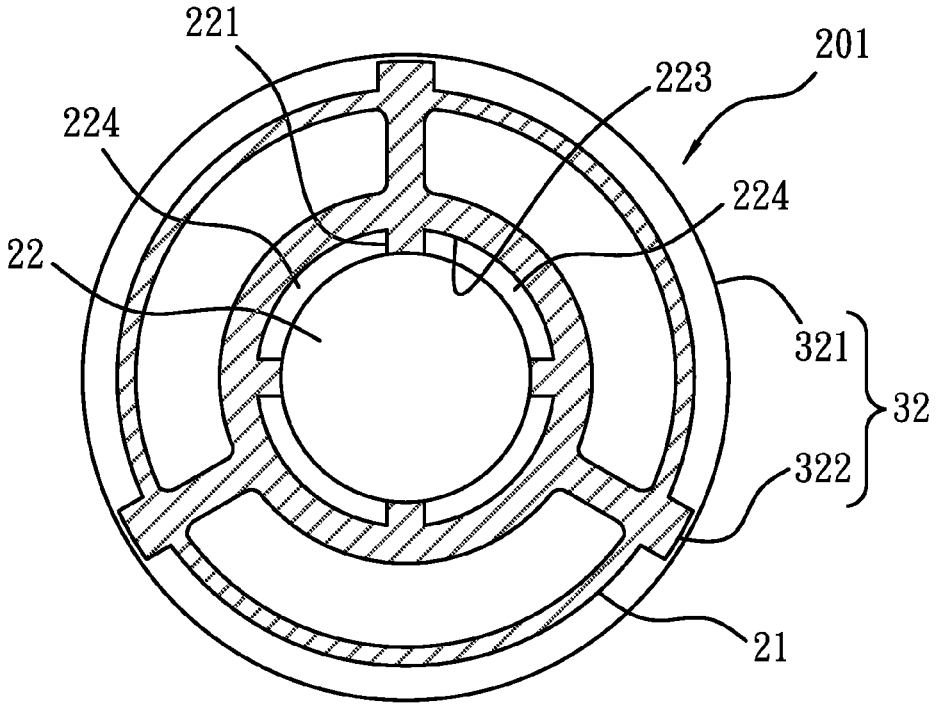
FIG. 8 is a cross sectional view taken along the line 3-3 of FIG. 6.

The stopper assembly 20, as illustrated in FIG. 5, includes a housing 201, a pushing member 202, a rotating member 203, a bottom casing 204, a spring 205, and a plug 206; wherein the housing 201, as shown in FIGS. 6-8, is installed in the hole 11 from the outlet 111 of the pipe set 10 and includes a peripheral wall 21 disposed on an outer surface thereof and having an aperture 22 defined in the peripheral wall 21, the aperture 22 includes four fixing ribs 221 formed therein and separated apart from each other equally, and each fixing rib 221 includes a first beveled face 222 arranged on a top end thereof, between each two adjacent fixing ribs 221 is defined a longitudinal slot 223, and each longitudinal slot 223 includes a closed wall 224 disposed on a top end thereof.

The peripheral wall 21 of the housing 201 includes three orifices 23 secured thereon vertically and a circularly raised segment 211 above the three orifices 23, wherein the three orifices 23 are spaced apart from one another.

Figure 9:
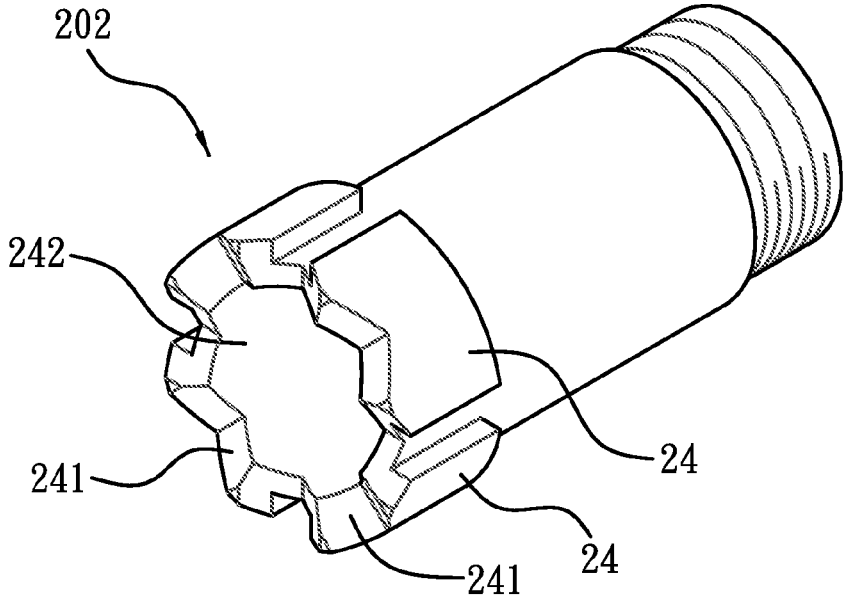
FIG. 9 is a perspective view showing the assembly of a pushing member of the press touch pop-up stopper according to the present invention.

The pushing member 202, as illustrated in FIG. 9, is retained in the aperture 22 from a bottom end of the housing 201 and includes a top end extending out of the housing 201, four sliding blocks 24 extending outward from an outer surface of a bottom end thereof and spaced apart from each other to move vertically along the longitudinal slots 223, and each sliding block 24 includes four second beveled faces 241 formed in a serration shape and secured on a bottom end thereof; the pushing member 202 also includes a cavity 242 arranged on the bottom end thereof.

Figure 10:
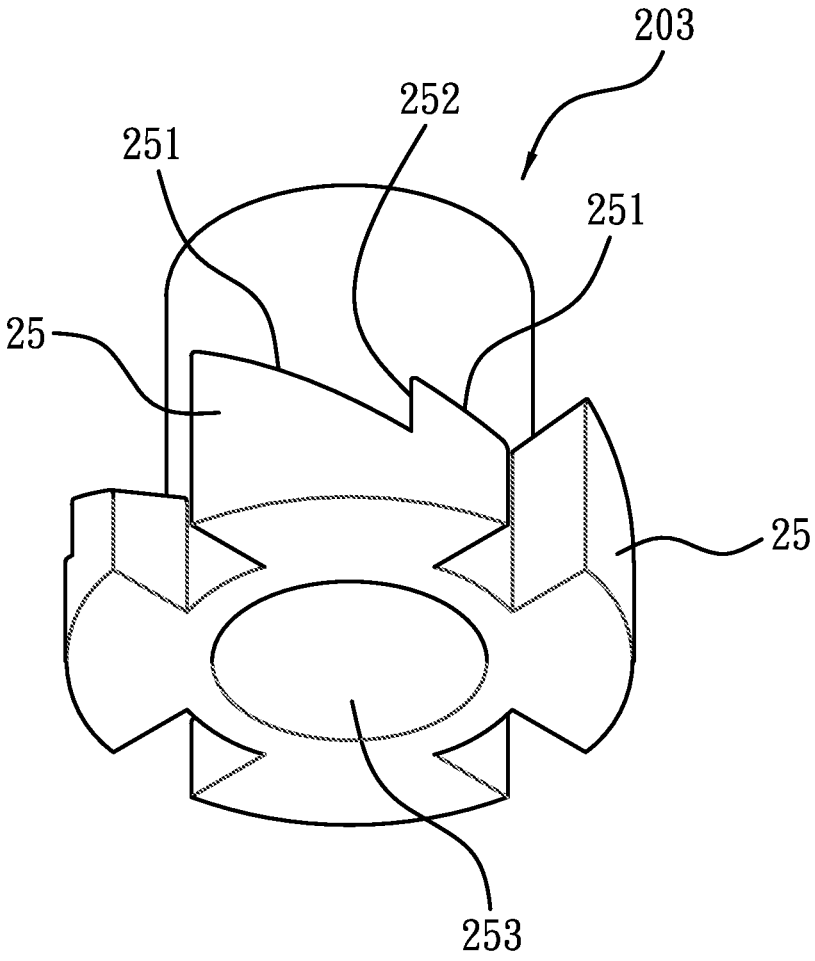
FIG. 10 is a perspective view showing the assembly of a rotating member of the press touch pop-up stopper according to the present invention.

The rotating member 203, as shown in FIG. 10, includes a top end fixed in the cavity 242 of the pushing member 202 and four projections 25 secured on an outer surface of a bottom end thereof and spaced apart from each other, each projection 25 includes two third beveled faces 251 formed on a top end thereof, and between the third beveled faces 251 of the projection 25 is defined a retaining fence 252. Thereby, the rotating member 203 is slid into the longitudinal slots 223 of the housing 201 by using the projections 25 to correspond to the sliding blocks 24 as shown in FIGS. 7 and 8 so as to be positioned at an upper position, and then the third beveled faces 251 are pushed by the second beveled faces 241 of the sliding block 24 to slide out of the longitudinal slots 223 and to further slide along the first beveled faces 222 of the fixing ribs 221 respectively, thus causing a rotation. Thereafter, the retaining fence 252 is retained in the fixing ribs 221 to be fixed at a lower position. As shown in FIG. 3, the rotating member 203 is located at the lower position.

The rotating member 203 further includes a chamber 253 disposed on a bottom end thereof.

The bottom casing 204 is screwed with the housing 201 and includes a groove 26 disposed on the top end thereof, and the groove 26 includes a plurality of bores 261 fixed on a bottom surface thereof as illustrated in FIG. 3.

The spring 205 includes two ends positioned in the chamber 253 of the rotating member 203 and the groove 26 of the bottom casing 204 respectively so that the rotating member 203 is pushed upward to the upper position, and the rotating member 203 is rotated to be fixed at the lower position.

A relative movement among the rotating member 203, the pushing member 202, the housing 201, and the spring 205 is identical to prior art, therefore further remarks are omitted.

The stopper assembly 20, as illustrated in FIGS. 3 and 5, is screwed with the top end of the pushing member 202, and when the stopper assembly 20 is pressed, the pushing member 202 slides downward to push the rotating member 203 so that the rotating member 203 is retained at the lower position, thereafter the plug 206 moves downward to close the outlet 111 of the pipe set 10, thereby stopping a water. When the stopper assembly 20 is pressed again, the rotating member 203 disengages from the lower position and is pushed by the spring 205 so that the stopper assembly 20 is actuated to bounce upward to the upper position so as to further turn on the outlet 111, thereby flowing the water.

The plug 206 is comprised of a body 27, a stop loop 28, and a lid 29. The body 27 includes a mouth 271 disposed on a central position of a bottom end thereof to screw with the pushing member 202 and to cover the circularly raised segment 211 of the housing 201 and a peripheral fence 272 extending thereon. The stop loop 28 is fixed on the peripheral fence 272 of the body 27 and is moved downward to close the outlet 111 of the pipe set 10 or is moved upward to turn on the outlet 111. The lid 29 is screwed with the body 27 and includes a peripheral rim 291 to space apart a certain distance from the positioning fringe 12 of the pipe set 10 to define a flowing gap 292 so that the water flows into the outlet 111 via the flowing gap 292.

The vertical connecting structure 30, as shown in FIGS. 3-5, is an elastic engaging structure and includes an internal unit 31 formed on an inner surface of the pipe set 10 and an external unit 32 formed on the outer surface of the housing 201.

The internal unit 31 includes two symmetrically resilient locking bumps 311, a number of longitudinal guiding recesses 312 arranged under a lower side of the resilient locking bumps 311, and a slit 313 defined between the locking bumps 311 and the slit 313.

The external unit 32 includes an annular shoulder 321 disposed on a top end of an outer side of the peripheral wall 21 of the housing 201 and a plurality of vertical guide members 322 arranged below the annular shoulder 321; the guide members 322 slide into the longitudinal guiding recesses 312 respectively to be retained in the slit 313 of the annular shoulder 321 so that the housing 201 is fixed in the pipe set 10 by means of the internal and the external units 31, 32, and while the housing 201 is pulled upward by the stopper assembly 20 to disengage from the resilient locking bumps 311 of the internal unit 31 by using the annular shoulder 321 of the external unit 32 of the vertical connecting structure 30 further, the guide members 322 slide upward along the longitudinal guiding recesses 312 to disengage from the pipe set 10, such that the stopper assembly 20 is removed from the pipe set 10 easily so that obstructions (such as hairs or soap remains) jammed in and between the pipe set 10 and the stopper assembly 20 are eliminated.

It is to be noted that the flowing gap 292 between the peripheral rim 291 of the lid 29 and the positioning fringe 12 of the pipe set 10 is provided to make a user hold and then pull the peripheral rim 291 upward easily.

After cleaning the pipe set 10 and the stopper assembly 20, the vertical guide members 322 of the external unit 32 of the vertical connecting structure 30 are aligned with the longitudinal guiding recesses 312 of the internal unit 31 individually, and the stopper assembly 20 is pressed so that the vertical guide members 322 slide into the longitudinal guiding recesses 312 respectively until the annular shoulder 321 is retained in the slit 313, hence the stopper assembly 20 is put back to the pipe set 10. Thereby, the vertical connecting structure 30 is served to connect the stopper assembly 20 with the pipe set 10 or disconnect the stopper assembly 20 from the pipe set 10 to clean the press touch pop-up stopper 1 easily; wherein because the external unit 32 is provided with the vertical guide members 322, and the internal unit 31 is provided with the longitudinal guiding recesses 312, the stopper assembly 20 is slid into the pipe set 10 to lower aligning time, thereby connecting the stopper assembly 20 with the pipe set 10 easily and quickly.

Furthermore, the three orifices 23 of the housing 201 are separated from the aperture 22, and among the housing 201, the pushing member 202, and the bottom casing 204 is defined a closed space, and the circularly raised segment 211 of the housing 201 is covered by the body 27 to prevent the water, the hairs, and the soap remains from entering into the closed space so that the stopper assembly 20 operates smoothly, and the spring 205 is prevented from soaking the water to cause rustiness.

The rotating member 203 is provided with the bores 261 so that after the stopper assembly 20 is removed from the pipe set 10 to be cleaned, the water leaves in the stopper assembly 20 will flow outward further.

A press touch pop-up stopper 1 according to a second embodiment of the present invention comprises a vertical connecting structure 30 defined between a pipe set 10 and a stopper assembly 20, but the vertical connecting structure 30 is magnetic and includes two opposite attracting elements fixed between the pipe set 10 and the stopper assembly 20, wherein at least one of the two attracting elements is magnetic, and the other one is attracted by the magnetic attracting element. Thereby, after the stopper assembly 20 is pulled upward and overcomes a magnetic attraction of the magnetic attracting element, it is easy to remove the stopper assembly 20 from the pipe set 10, and while the stopper assembly 20 is pressed to be further put in the pipe set 10, the two attracting elements attract each other so that the stopper assembly 20 is put back to the pipe set 10.

It is to be noted that after the plug 206 of the stopper assembly 20 is pressed to flow the water outward, it bounces upward automatically to further force the housing 201, wherein as designing the vertical connecting structure 30, a vertical connecting force is designed to be more than an upward bouncing force of the housing 201 so that related components between the stopper assembly 20 and the pipe set 10 are not influenced during a pressing operation.

Since some components of the stopper assembly 20 are screwed together, for example, the lid 29 is screwed with the body 27, and the body 27 is screwed with the pushing member 202, screwing portions of the lid 29, the body 27, and the pushing member 202 is capable of being prevented from damage by using the vertical connecting design of the vertical connecting structure 30. Furthermore, if a rotating force is applied to connect the stopper assembly 20 with the pipe set 20, it acts between the pushing member 202 and the housing 201 indirectly, therefore the sliding blocks 24 of the pushing member 202 and the longitudinal slots 223 will be damaged. Accordingly, the vertical connecting design of the vertical connecting structure 30 is capable of preventing from the damage of the stopper assembly 20 when disconnecting and connecting the stopper assembly 20 from and with the pipe set 10.

While we have shown and described various embodiments in accordance with the present invention, it is clear to those skilled in the art that further embodiments may be made without departing from the scope of the present invention.

What is claimed is:

1. A press touch pop-up stopper used in a basin comprising:

a pipe set fixed in an opening of a bottom end of the basin and including a hole disposed therein and having an outlet fixed on a top end of the hole;

a stopper assembly received in the pipe set and including a plug, after the plug is pressed, it bounces automatically to turn on the outlet so as to flow water, after the plug is pressed again, it closing the outlet to stop flowing the water;

a vertical connecting structure defined between the pipe set and the stopper assembly so that when the stopper assembly is pulled upward, it disengages from the pipe set, and when the stopper assembly is pressed downward to be received in the pipe set, it is connected with the pipe set;

a housing installed in the hole from the outlet of the pipe set;

a pushing member moving vertically in the housing and including a top end extending out of the housing;

a rotating member sliding into the housing upward and to be positioned at an upper position or pushed downward by the pushing member to be retained in the housing and positioned at a lower position;

a bottom casing connected with a bottom end of the housing;

a spring positioned between the rotating member and the bottom casing so that the rotating member is pushed upward to the upper position, and the rotating member is rotated to be fixed at the lower position;

the plug connected with the top end of the pushing member;

wherein the housing includes a peripheral wall having an aperture defined in the peripheral wall, the aperture includes four fixing ribs formed therein and separated apart from each other equally, and each fixing rib includes a first beveled face arranged on a top end thereof, between each two adjacent fixing ribs is defined a longitudinal slot, and each longitudinal slot includes a closed wall disposed on a top end thereof, the peripheral wall includes at least one orifice secured thereon vertically;

the pushing member includes a plurality of sliding blocks extending outward from an outer surface of a bottom end thereof and spaced apart from each other to move vertically along the longitudinal slots, and each sliding block includes four second beveled faces formed in a serration shape and secured on a bottom end thereof;

the pushing member also includes a cavity arranged on the bottom end thereof;

the rotating member includes a top end fixed in the cavity of the pushing member and a number of projections secured on an outer surface of a bottom end thereof and spaced apart from each other, each projection includes two third beveled faces formed on a top end thereof, and between the third beveled faces of the projection is defined a retaining fence, the rotating member is slid into the longitudinal slots of the housing by using the projections to correspond to the sliding blocks so as to be positioned at the upper position, and then the third beveled faces are pushed by the second beveled faces of the sliding block to slide out of the longitudinal slots and to further slide along the first beveled faces of the fixing ribs respectively, thus causing a rotation, thereafter the retaining fence is retained in the fixing ribs to be fixed at the lower position.

2. The press touch pop-up stopper as claimed in claim 1, wherein the rotating member further includes a chamber disposed on the bottom end thereof, and the bottom casing includes a groove disposed on the top end thereof, such that two ends of the spring are fixed in the rotating member and the bottom casing individually.

3. The press touch pop-up stopper as claimed in claim 1, wherein the groove of the bottom casing includes a plurality of bores fixed on a bottom surface thereof.

4. The press touch pop-up stopper as claimed in claim 1, wherein the plug further comprises:

a body including a mouth disposed on a central position of a bottom end thereof to screw with the pushing member and a peripheral fence extending thereon;

a stop loop fixed on the peripheral fence of the body and being moved downward to close the outlet of the pipe set or being moved upward to turn on the outlet;

a lid screwed with the body and includes a peripheral rim to space apart a certain distance from a top end of the pipe set to define a flowing gap.

5. A press touch pop-up stopper used in a basin comprising:

a pipe set fixed in an opening of a bottom end of the basin and including a hole disposed therein and having an outlet fixed on a top end of the hole;

a stopper assembly received in the pipe set and including a plug, after the plug is pressed, it bounces automatically to turn on the outlet so as to flow water, after the plug is pressed again, it closing the outlet to stop flowing the water;

a vertical connecting structure defined between the pipe set and the stopper assembly so that when the stopper assembly is pulled upward, it disengages from the pipe set, and when the stopper assembly is pressed downward to be received in the pipe set, it is connected with the pipe set;

a housing installed in the hole from the outlet of the pipe set;

a pushing member moving vertically in the housing and including a top end extending out of the housing;

a rotating member sliding into the housing upward and to be positioned at an upper position or pushed downward by the pushing member to be retained in the housing and positioned at a lower position;

a bottom casing connected with a bottom end of the housing;

a spring positioned between the rotating member and the bottom casing so that the rotating member is pushed upward to the upper position, and the rotating member is rotated to be fixed at the lower position;

the plug connected with the top end of the pushing member;

wherein the vertical connecting structure is an engaging structure;

wherein the engaging structure includes an internal unit formed on an inner surface of the pipe set and an external unit formed on the outer surface of the housing;

the internal unit includes two symmetrically resilient locking bumps, a number of longitudinal guiding recesses arranged under a lower side of the resilient locking bumps, and a slit defined between the locking bumps and the slit;

the external unit includes an annular shoulder disposed on a top end of an outer side of the peripheral wall of the housing and a plurality of vertical guide members arranged below the annular shoulder; the guide members slide into or out of the longitudinal guiding recesses respectively, and the annular shoulder slides into the slit to be engaged vertically or slide out of the slit vertically to be disengaged.

6. The press touch pop-up stopper as claimed in claim 1, wherein the vertical connecting structure is an engaging structure.

7. The press touch pop-up stopper as claimed in claim 1, wherein the pipe set includes a positioning fringe formed on the top end thereof to contact with an inner surface of the opening of the basin, two opposite air vents arranged thereon, outer threads secured on a bottom end thereof to screw with a nut so that a sealing ring of the pipe set engages with an outer surface of the bottom end of the basin.

* * * * *